United States Patent [19]

Gano

[11] 3,960,285

[45] June 1, 1976

[54] MATERIAL HANDLING APPARATUS

[75] Inventor: John W. Gano, New Philadelphia, Ohio

[73] Assignee: The Warner & Swasey Company, Cleveland, Ohio

[22] Filed: Oct. 4, 1974

[21] Appl. No.: 512,249

[52] U.S. Cl. ..... 214/141; 212/55

[51] Int. Cl.[2] ..... E02F 3/38

[58] Field of Search..... 214/141, 146.5, 147 G; 212/69, 54, 55, 58, 59; 37/103

[56] References Cited

UNITED STATES PATENTS

| | | | |
|---|---|---|---|
| 3,224,608 | 12/1965 | Yadon et al. | 214/141 |
| 3,329,291 | 7/1967 | Przybylski et al. | 214/141 |
| 3,369,672 | 2/1968 | Lorence | 212/69 |
| 3,396,860 | 8/1968 | Witwer et al. | 214/141 |
| 3,666,125 | 5/1972 | Gano et al. | 214/141 |
| 3,700,126 | 10/1972 | Beaton | 214/141 |
| 3,871,538 | 3/1975 | Miller et al. | 214/141 |

*Primary Examiner*—Robert J. Spar
*Assistant Examiner*—Ross Weaver

[57] ABSTRACT

A material handling apparatus includes an improved force transmitting assembly which is utilized to rotate a base boom section relative to a cradle and to retain the base boom section against axial movement relative to the cradle. The force transmitting assemby is advantageously disposed between an inner end portion of the base boom section and an upstanding end portion of the cradle and includes a gear drive arrangement which is operated by a relatively high speed motor to rotate the base boom section about its central axis at a relatively low speed. The gear drive arrangement includes a stator or internally toothed ring gear which is fixedly connected with the cradle. A rotor gear or wheel has an external diameter which is less than the internal diameter of the ring gear and has external teeth which are disposed in meshing engagement with the internal teeth of the ring gear. The central axis of the rotor gear is offset from the central axis of the ring gear. An eccentric is rotatable by the relatively high speed motor to effect orbital movement of the rotor gear about the central axis of the ring gear. During this orbital movement of the rotor gear, the teeth of the ring and rotor gears cooperate to effect rotational movement of the rotor gear about its own central axis at a relatively low speed. This low speed rotational movement of the rotor gear is utilized to effect low speed rotation of the base boom section about its central axis. A thrust bearing assembly is advantageously mounted in a coaxial relationship with the eccentric to hold the base boom section against axial movement relative to the cradle.

21 Claims, 4 Drawing Figures

MATERIAL HANDLING APPARATUS

BACKGROUND OF THE INVENTION

A material handling apparatus constructed in accordance with the present invention includes an improved force transmitting assembly for rotating a boom section about its central axis. There are many known material handling devices which utilize boom sections which are rotatable about their central or longitudinal axes. Some of these known material handling devices are disclosed in U.S. Pat. Nos. 3,700,126; 3,224,608; 3,042,234; and 2,541,045. Although the drive arrangements utilized to rotate the boom sections of these known material handling devices have been more or less satisfactory in their mode of operation, at least some of the known drive arrangements include relatively powerful and expensive low speed drive motors which are operated to rotate the boom section about its longitudinal axis. In addition, at least some of the known drive arrangements have been relatively bulky and utilized complicated motor and pulley arrangements to rotate the boom section.

SUMMARY OF THE PRESENT INVENTION

The present invention provides a new and improved material handling apparatus having an improved force transmitting assembly for effecting rotation of a boom section about its central axis. The improved force transmitting assembly may also include a thrust bearing arrangement to retain the boom section against axial movement. The force transmitting assembly includes a gear drive arrangement which enables a relatively inexpensive and low torque drive motor to be utilized to drive an input gear at relatively high speeds. Due to the relatively large speed reduction provided by the improved gear drive arrangement, an output member from the gear drive arrangement is moved at a relatively low speed to slowly rotate an associated boom section. Of course, the relatively large speed reduction obtained by the improved gear drive arrangement enables the high speed low torque input motor to effect rotation of the boom section at relatively low speeds against the influence of relatively large operating loads.

The improved gear drive arrangement has a relatively compact construction and may advantageously be disposed between an inner end portion of the boom section and an upstanding portion of a cradle assembly on which the boom section is supported. The gear drive arrangement includes an internally toothed ring or stator gear which is fixedly connected with the cradle assembly. An externally toothed rotor gear or wheel has a smaller external diameter than the internal diameter of the ring gear and is disposed in meshing engagement with the ring gear. An eccentric is rotatable by the high speed, low torque input motor to effect orbital movement of the rotor gear relative to the ring gear. As the rotor gear orbits relative to the ring gear, the teeth on the ring and rotor gears effect rotation of the rotor gear about its central axis at a relatively low speed. A suitable coupling arrangement is utilized to transmit this low speed rotational movement of the rotor gear to the boom section to thereby effect low speed rotation of the boom section about its central axis. The compact construction of the material handling apparatus is promoted by mounting a thrust bearing assembly which retains the boom section against axial movement, in a coaxial relationship with the gear drive arrangement.

Accordingly, it is an object of this invention to provide a new and improved gear drive arrangement which enables a relatively inexpensive low torque motor having a high speed output to be utilized to rotate a boom section at a relatively low speed about its central axis against the influence of relatively large forces.

Another object of this invention is to provide a new and improved drive arrangement which is relatively compact in construction and can be mounted between an inner end portion of the boom section and a cradle upon which the boom section is rotatably supported.

Another object of this invention is to provide a new and improved drive arrangement for rotating a boom section about its central axis and wherein the drive arrangement includes an externally toothed ring gear which is disposed in a coaxial relationship with the boom section, an externally toothed rotor gear which is disposed in meshing engagement with the internally toothed ring gear, and a drive to effect orbital movement of the rotor gear about the central axis of the ring gear in such a manner that the external teeth on the rotor gear and the internal teeth on the ring gear cooperate to rotate the rotor gear about its central axis to thereby effect rotation of the boom section about its central axis.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
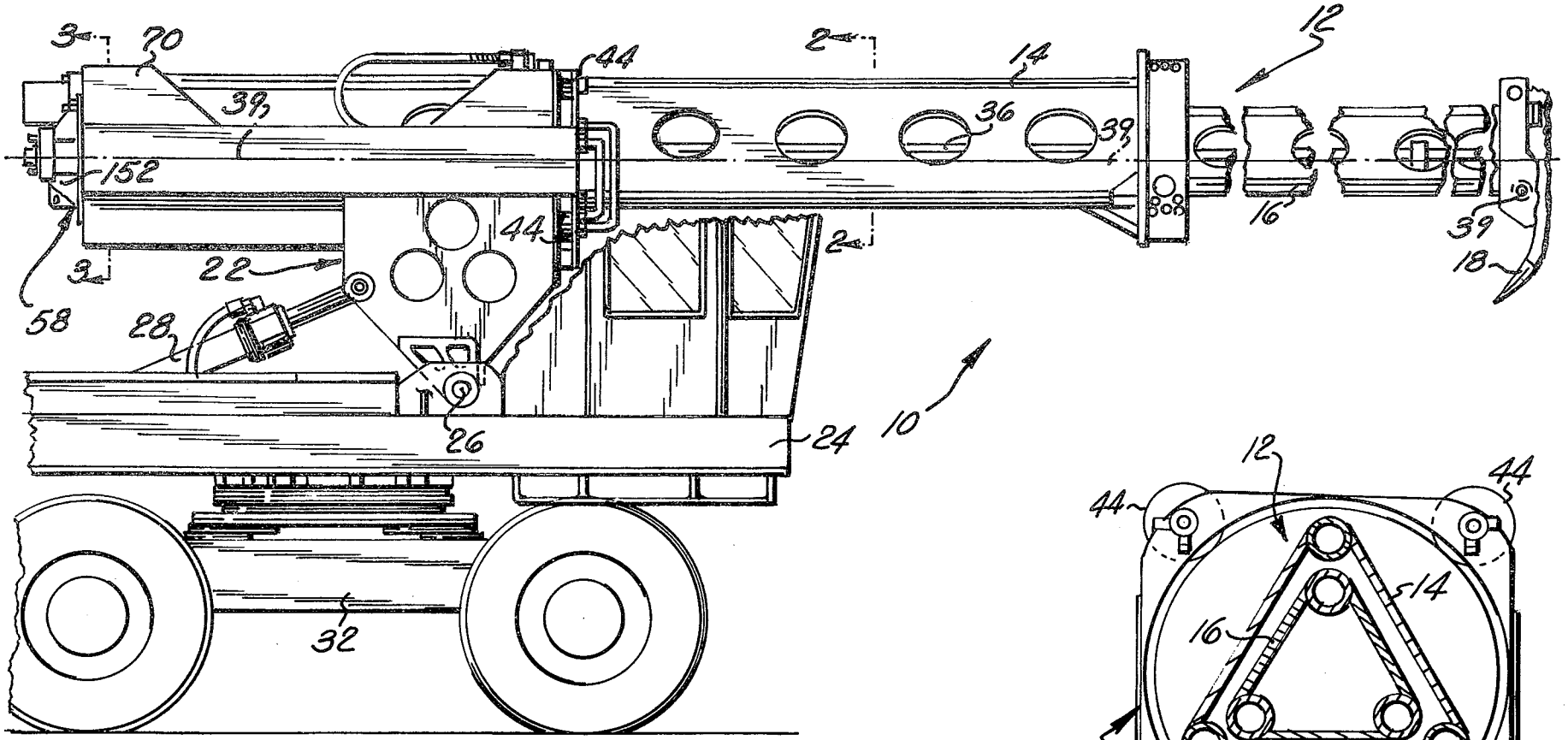
FIG. 1 is a partially broken away elevational view of an improved material handling apparatus constructed in accordance with the present invention.

A material handling apparatus 10 constructed in accordance with the present invention is illustrated in FIG. 1 and includes a boom assembly 12 having a base boom section 14 which telescopically receives a second boom section 16 having an outer end portion upon which a suitable tool 18 is mounted. The boom assembly 12 is disposed in a cradle assembly 22 which is pivotal relative to a platform or base 24 about a pivot connection 26 by a piston and cylinder type motor 28. The base 24 is pivotally mounted on a suitable support structure 32 which is illustrated schematically in FIG. 1 and may have one of many known constructions such as those illustrated in U.S. Pat. Nos. 3,494,439 and 3,599,814.

To enable the tool 18 to perform work operations, a piston and cylinder type motor assembly 36 is extensible and retractable to move the second boom section 16 relative to the base boom section 12 in a known manner. The second boom section 16 is supported by suitable rollers for axial movement relative to the base boom section 14 and is provided with suitable hydraulic conduits to conduct hydraulic fluid to a motor (not shown) for pivoting the tool 18 about a connection 38 in the manner disclosed in U.S. Pat. No. 3,666,125.

Figure 2:
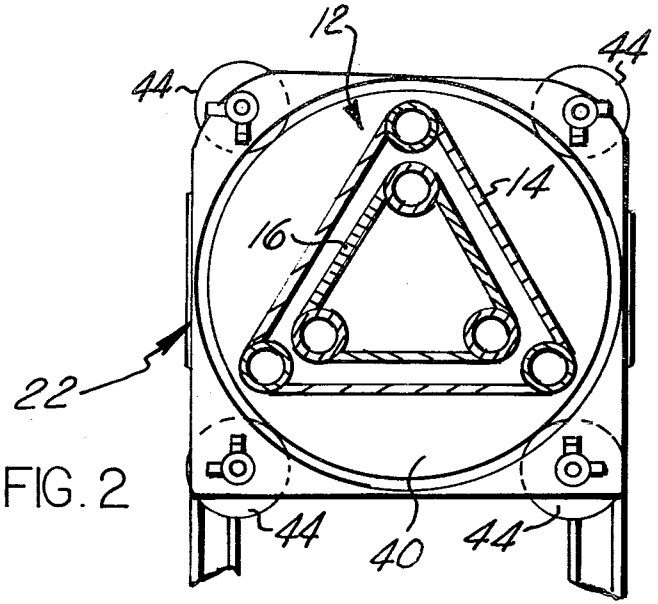
FIG. 2 is a simplified sectional view, taken on an enlarged scale along the line 2—2 of FIG. 1, illustrating the manner in which a base boom section is mounted on a cradle and in which a second boom section is telescopically received in the base boom section.

The boom assembly 14 is supported for rotational movement relative to the cradle assembly 22 about a longitudinal central axis 39 of the two boom sections 14 and 16. Thus, a support plate 40 (FIG. 2) connected with the boom assembly 12 is rotatably supported by a plurality of rollers 44 disposed adjacent to the outer end portion of the cradle assembly 22. The inner end portion of the base boom section 14 is supported on and held against axial movement by a thrust bearing assembly 48 (see FIG. 4) which is coaxial with the boom axis 39. Thus, the cradle assembly 22 supports the base boom section 14 on the rollers 44 and thrust bearing assembly 48 for rotation about the central longitudinally extending axis 39 (see FIG. 4) of the base boom section 14. The second boom section 16 is telescopically received within the base boom section 14 and is movable axially relative to the base boom section to vary the longitudinal extent of the boom assembly 12.

The thrust bearing assembly 48 (FIG. 4) forms a part of an improved force transmitting assembly 56 for rotating the base boom section 14 about its central longitudinal axis 39 and for retaining the base boom section against axial movement relative to the cradle or base assembly 22. In accordance with one feature of the present invention, the force transmitting assembly 56 is relatively compact and is disposed between an end portion 58 of the cradle or base assembly 22 (see FIGS. 1 and 4) and a rear or inner wall 60 (FIG. 4) of the base boom section 14. By locating the force transmitting assembly 56 between the end wall 60 of the base boom section 14 and the end portion 58 of the cradle assembly 22, the force transmitting assembly is fully enclosed and protected against damage by engagement with various objects during movement of the cradle assembly. Of course, enclosing the force transmitting assembly 56 in this manner tends to reduce the amount of foreign materials, such as dirt and sand, to which the various components of the force transmitting assembly are exposed during operation of material handling apparatus 10.

The force transmitting assembly 56 includes an improved gear drive arrangement 64 (FIG. 4) which is utilized to reduce the relatively high output speed of an inexpensive and low torque drive motor 66 to effect rotation of the boom sections 14 and 16 about the central axis 39 at a relatively low speed and with a relatively high torque. This enables the boom assembly 12 to be rotated relative to the cradle assembly 22 against the influence of substantial loads during operation of the material handling apparatus 10. It should be noted that the thrust bearing assembly 48 is disposed within the gear drive arrangement 64 to promote the compact construction of the force transmitting assembly 56.

The improved gear drive arrangement 64 includes an annular ring gear or stator 68 (FIG. 3) which is fixedly connected with a cylindrical outer shell 70 of the cradle or base assembly 22. The ring gear 68 is provided with an annular array of internal gear teeth 72 which circumscribe a rotor wheel or gear 74 having a pitch diameter which is less than the pitch diameter of the ring gear 68. An annular array of external gear teeth 76 are formed on the periphery of the rotor gear 74. The central axis of the ring gear 68 is coincident with the longitudinally extending central axis 39 of the base boom section 14. However, a central axis 80 of the rotor gear 74 (see FIG. 4) is spaced apart from and extends parallel to the longitudinal central axis 39 of the ring gear 68.

Figure 3:
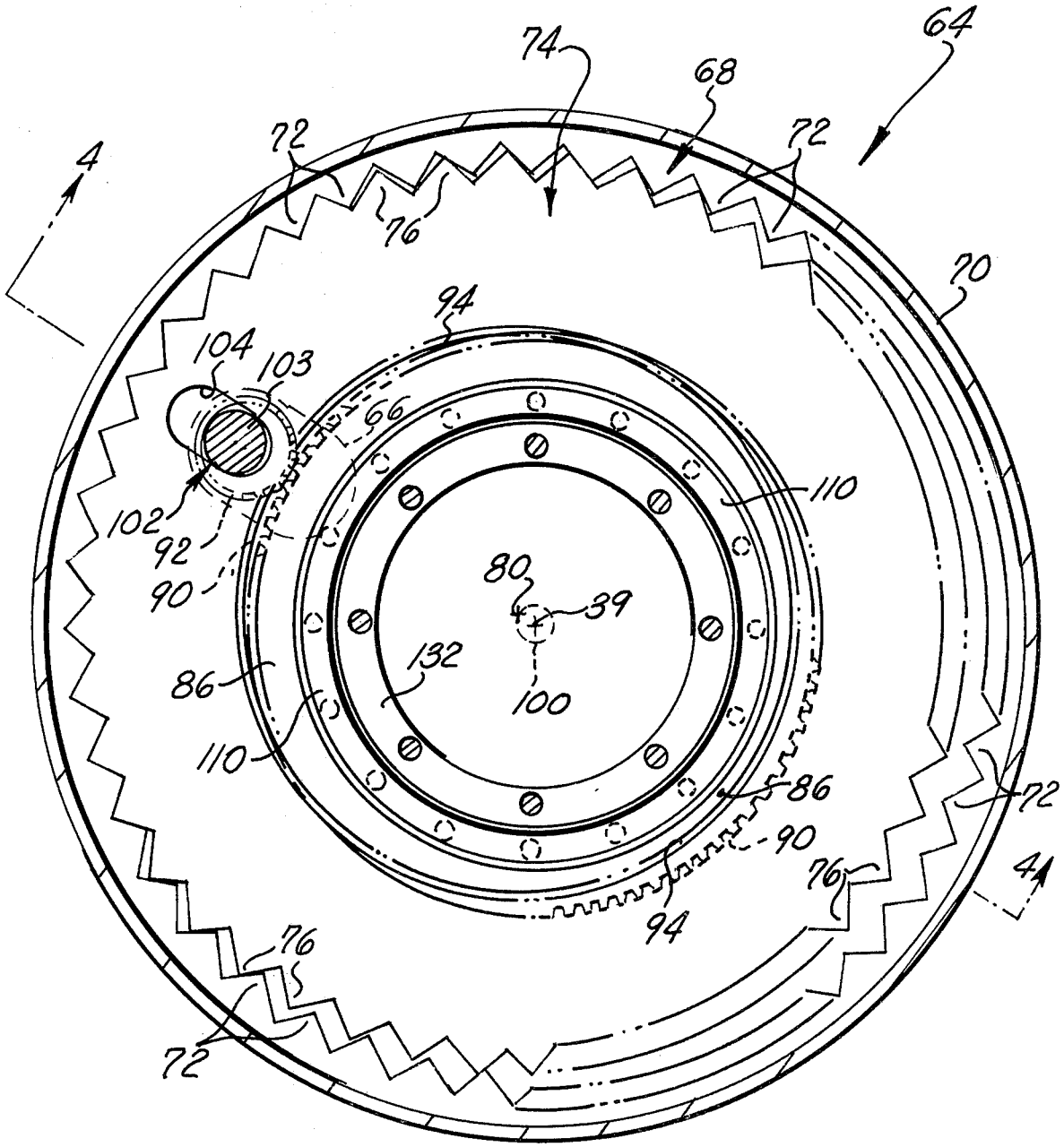
FIG. 3 is an enlarged sectional view, taken generally along the line 3—3 of FIG. 2, illustrating the construction of a gear drive arrangement for effecting rotational movement of the base boom section relative to the cradle.

Since the ring gear 68 has a larger pitch diameter than the pitch diameter of the rotor gear 74, only a portion of the teeth 76 of the rotor gear are disposed in meshing engagement with the teeth 72 on the ring gear (see FIG. 3). It should be noted that on one side of the rotor gear 74, that is the upper left side as viewed in FIG. 3, the rotor teeth 76 are in meshing engagement with the ring gear teeth 72 while on the diametrically opposite side, that is the lower right side of the rotor gear 74 as viewed in FIG. 3, the rotor gear teeth 76 are spaced apart from the ring gear teeth 72. This spacing between the teeth of the rotor gear 74 and ring gear 68 enables the rotor gear to be orbited about the central axis 39 of the ring gear upon rotation of an annular eccentric member 86 about the axis 39.

The eccentric member 86 is provided with a drive gear 90 which is disposed in meshing engagement with an input gear 92 driven by the relatively low torque high speed motor 66. The drive gear 90 is disposed in a coaxial relationship with the ring gear 68. The eccentric member 86 is provided with a circular outer surface 94 having a central axis which is coaxial with the rotor gear axis 80 (see FIG. 3). Since the outer surface 94 is eccentric or radially offset relative to the axis 39 of the ring gear 68, rotation of the eccentric member 86 about the axis 39 by the drive motor 66 causes the eccentric outer surface 94 to cooperate with a rotor gear support bearing assembly 98 (see FIG. 4) to effect orbital movement of the rotor gear 74 about the central axis 39 of the ring gear 52. As the rotor gear 74 orbits about the ring gear 72, its central axis 80 moves along a circular path indicated at 100 in FIG. 3 and having its center at the axis 39. Also during orbital movement of the rotor gear 74 about the axis 39, the meshing engagement between the ring gear teeth 72 and rotor gear teeth 76 causes the rotor gear to rotate about its own central axis 80. Therefore, upon rotation of the eccentric 86 about the central axis 39, the rotor gear 74 is orbited about the axis 39 and rotated about its own central axis 80.

Figure 4:
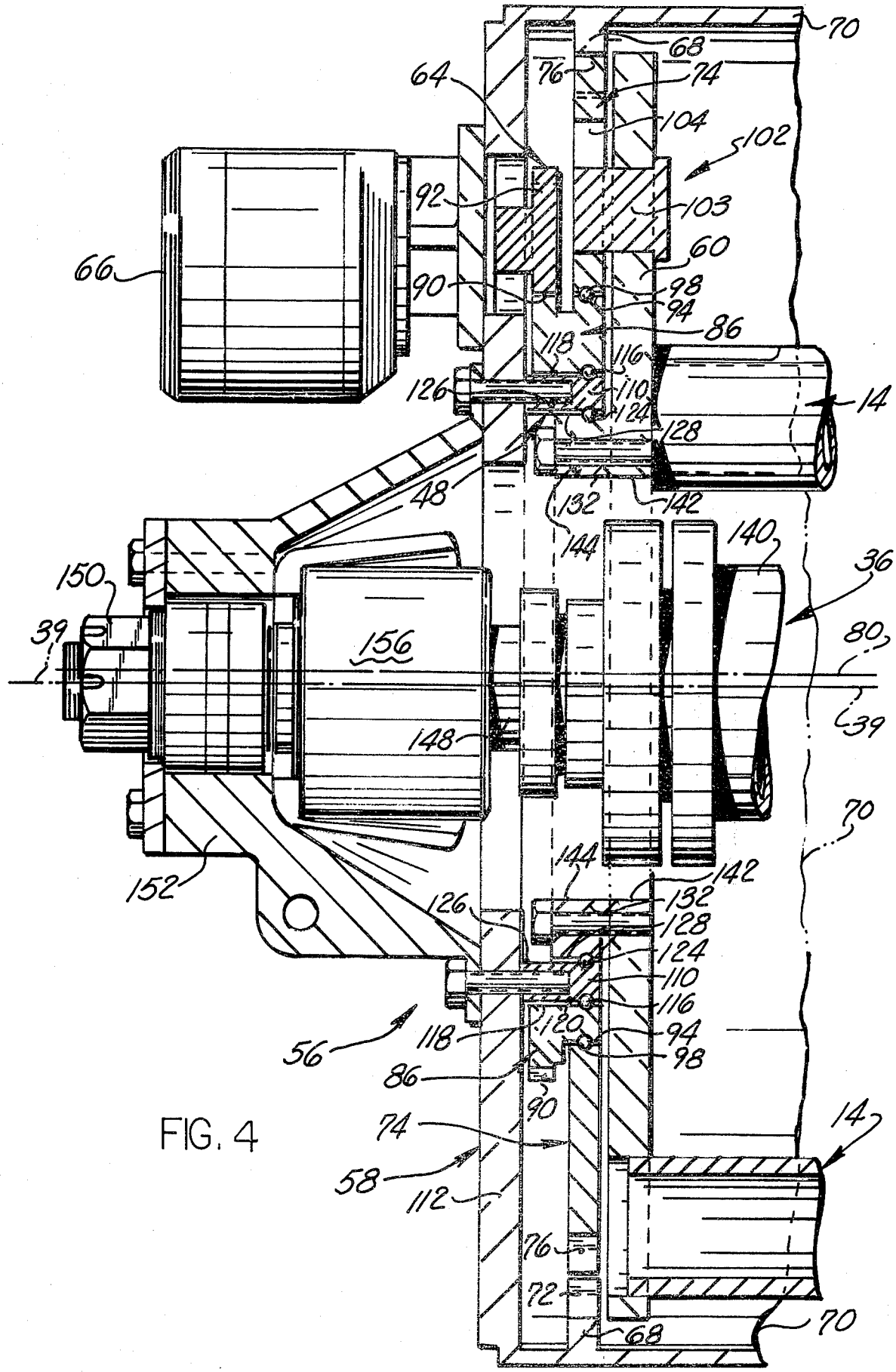
FIG. 4 is an enlarged sectional view, taken generally along the line 4—4 of FIG. 3, illustrating the relationship between the gear drive arrangement, a high speed, low torque input motor, and the base boom section.

The rotational movement of the rotor gear 74 about its own central axis 80 is transmitted to the base boom section 14 by a coupling 102 (see FIGS. 3 and 4). The coupling 102 includes a drive pin 103 which is fixedly connected to the end wall 60 of the base boom section 14 and extends into a slot 104 formed in the rotor gear 74. The elongated slot 104 has an axial extent sufficient to accommodate the sideways or radial movement of the rotor gear 74 under the influence of the eccentric 86. During operation of the motor 66, the rotor gear 74 rotates about the axis 80 at a rate determined by the difference between the number of ring gear teeth 72 and the number of rotor gear teeth 76. Thus, if the number of rotor gear teeth 76 is two less than the number of ring gear teeth 72, the rotor gear will be rotated or indexed about the axis 80 through a distance corresponding to two rotor gear teeth upon each revolution of orbital movement of the rotor gear 74 relative to the ring gear 68.

The direction in which the rotor gear 74 is orbited about the axis 39 by the eccentric 86 is opposite from the direction in which it is rotated about the axis 80 by the meshing engagement between the rotor gear teeth 76 and ring gear teeth 72. Thus, if the eccentric 86 is rotated about the axis 39 in a clockwise direction as viewed in FIG. 3, the axis 80 of the rotor gear 74 moves in a clockwise direction about the axis 39 along the path 100. As the rotor gear 74 orbits in a clockwise direction, it rotates in a counterclockwise direction at a much lower speed about its own axis 80. Of course, the drive pin 103 rotates the base boom section 14 in the same direction and at the same rate as in which the rotor gear 74 is rotated about its own axis 80.

Due to the relatively large speed reduction and high torque multiplication obtained by the gear drive arrangement 64, a relatively inexpensive high speed motor 66 having a low torque output can be utilized to rotate the base boom section 14 at a relatively low speed and high torque. Of course, this low speed and high torque drive of the base boom section 14 is necessary to enable it to overcome the relatively large load forces which are encountered by the tool 18 during normal operation of the material handling apparatus 10. It should be noted that the gear drive arrangement 64 enables the base boom section 14 and the second boom section 16 to be rotated through any desired number of revolutions about their coincident longitudinal axis 39 without reversing the direction of rotation of the base boom section. It should also be noted that the drive motor 66 is mounted on the end portion 58 of the cradle assembly 22 at a location wherein it is readily accessible and where it can be replaced if necessary without dismantling the boom assembly 12.

The eccentric member 86 is supported for rotational movement about the axis 39 on a cylindrical wall 110 which is fixedly connected to an end wall 112 of the cradle or base assembly 22. Rotational movement of the eccentric member 56 relative to the support wall 110 is promoted by a circular bearing assembly 116 disposed between a circular inner surface 118 of the eccentric member 86 and a cylindrical outer surface 120 of the support wall 110. It should be noted that the circular bearing assembly 116 and support wall 110 are disposed in a coaxial relationship with the central axis 39 of the base boom section 14 while the circular rotor gear bearing support assembly 98 is disposed in a coaxial relationship with the central axis 80 of the rotor gear 74.

The compact construction of the force transmitting assembly 56 is promoted by the fact that the thrust bearing assembly 48 which rotatably supports the inner boom section 14 and holds it against axial movement is disposed within the gear drive arrangement 64. Thus, the thrust bearing assembly 48 includes a circular bearing assembly 124 which is disposed between a cylindrical inner surface 126 of the support wall 110 and a cylindrical outer surface 128 of a bearing wall 132 fixedly connected with the end wall 60 of the base boom section 14. The support wall 110, bearing assembly 124 and bearing wall 132 are disposed within the eccentric 86 and cooperate in a known manner to prevent axial and radial movement of the base boom section 14 relative to the cradle assembly 22. The bearing wall 132 and bearing assembly 124 are disposed in a coaxial relationship with the central axis 39 of the boom assembly 12. It should be noted that the various bearing assemblies 98, 116 and 124 cooperate with the bearing support wall 110 to retain the rotor gear 74, eccentric member 86 and base boom section 14 against axial and radial movement relative to the end wall 112 of the cradle assembly 22 while enabling these various components to rotate relative to the cradle end wall about either the axis 39 or the axis 80 respectively.

In order to tend to minimize the axial thrust forces applied to the outer or base boom section 14, the drive motor 36 for moving the second boom section 16 relative to the base boom section 14 is connected directly with the end portion 58 of the cradle assembly 22. Thus, the motor 36 includes a cylinder 140 which extends axially into a circular opening 142 in the end wall 60 of the base boom section 14 when the second boom section 16 is retracted. The cylindrical bearing support wall 132 is disposed in a coaxial relationship with the opening 142 and defines a second circular opening 144. A piston rod 148 of the piston and cylinder type motor assembly 36 is fixedly connected at 150 with a bearing cradle end wall 152 (see FIGS. 1 and 4). A gland assembly 156 is provided to distribute fluid to the motor assembly 36 in a known manner. Thus, the motor 36 for moving the second boom section 16 relative to the base boom section 14 extends through the end wall 60 of the base boom section 14, the thrust bearing assembly 48 and the gear drive arrangement 64. The motor 36 is connected with the end wall 152 of the cradle assembly 22 independently of the base boom section 14, the thrust bearing assembly 48 and the gear drive arrangement 64. This mounting of the motor 36 is facilitated by the fact that the motor 36 has a longitudinally extending central axis which is coincident with the central axis 39 of the base boom section 14.

Although the boom assembly 12 is disclosed herein as only having two boom sections, that is the base boom section 14 and second boom section 16, it is contemplated that the boom assembly could be provided with either a greater or fewer number of sections if desired. It should also be understood that although the gear drive arrangement 64 effects simultaneous rotation of the base boom section 14 and second boom section 16 about the central axis 39, it is contemplated that the gear drive arrangement could be connected with the various sections of the boom assembly in a different manner. The rotor gear 74 has been disclosed herein as being a rigid member which is orbited by the single lobe of the eccentric member 86. However, it is contemplated that the rotor gear 74 could take other known forms and could even be made flexible to engage opposite sides of the ring gear 68. Although the gear drive arrangement 64 is advantageously disposed between end wall 60 of the inner boom section 14 and the end wall 112 of the cradle assembly 22, it is contemplated that the gear drive arrangement 64 could be mounted in a different orientation relative to the base boom section 14. Of course, if the gear drive arrangement 64 were mounted in a different orientation relative to the base boom section 14, the motor 36 for moving the second boom section 16 axially relative to the base boom section 14 would, probably, not extend through the gear drive arrangement.

In view of the foregoing description, it can be seen that the material handling apparatus 10 has an improved force transmitting assembly 56 for effecting rotation of the base boom section 14 about its central axis 39 and for retaining the base boom section against axial and radial movement relative to the cradle assembly 22. The force transmitting assembly 56 includes an improved gear drive arrangement 64 which enables a relatively inexpensive and low torque drive motor 66 to be utilized to drive an input gear 32 at a relatively high speed. The gear drive arrangement 64 provides a relatively large speed reduction so that the drive pin 103 is moved at a relatively low speed to rotate the base boom section 14 at a relatively low speed. Of course, the relatively large speed reduction obtained by the improved gear drive arrangement 64 enables the high speed low torque motor 66 to effect rotation of the boom section 14 at relatively low speeds against the influence of relatively large operating loads.

The gear drive arrangement 64 has a relatively compact construction and is advantageously disposed between the inner end wall 60 of the base boom section 14 and an upstanding end portion 58 of the cradle or base assembly 22. The gear drive arrangement 64 includes an internally toothed ring or stator gear 68 which is fixedly connected to the cradle assembly 22. An externally toothed rotor gear or wheel 74 has a smaller external diameter than the internal diameter than the ring gear 68 and is disposed in meshing engagement with the ring gear. An eccentric 86 is rotatable by the high speed, low torque input motor 66 to effect orbital movement of the rotor gear 74 relative to the ring gear 68. As the rotor gear 74 rotates relative to the ring gear 68, the teeth 72 and 76 on the ring and rotor gears effect rotation of the rotor gear about its central axis 80 at a relatively low speed. A suitable coupling arrangement 102 is utilized to transmit this low speed rotational movement of the rotor gear 74 to the base boom section 14 to thereby effect low speed rotation of the boom section about its own central axis 39. The compact construction of the material handling apparatus 10 is promoted by mounting a thrust bearing assembly 48 which retains the boom section 14 against axial and radial movement, in a coaxial relationship with the gear drive arrangement 64.

Having described one specific embodiment of the invention, the following is claimed:

1. A material handling apparatus comprising a base, a longitudinally extending first boom section having axially inner and outer end portions, said inner end portion of said first boom section having an end wall which defines a first opening, a longitudinally extending second boom section telescopically disposed within said first boom section and extending through said axially outer end portion of said first boom section, cradle means connected with said base for supporting said first and second boom sections, first motor means for effecting axial movement between said first and second boom sections to vary the telescopic relationship between said boom sections, second motor means for effecting rotational movement of said first and second boom sections about their longitudinally extending axes, and force transmitting means for transmitting rotational drive forces from said second motor means to said first boom section and for retaining said first boom section against axial movement relative to said cradle means, said cradle means including a longitudinally extending body which at least partially defines a cavity for receiving said first boom section and an end portion connected with said body and extending transversely to the longitudinal axis of said body to at least partially define one end of said cavity, said inner end portion of said first boom section including an end wall disposed adjacent to said end portion of said cradle means, said force transmitting means including gear means disposed within said cavity between said end wall of said first boom section and said end portion of said cradle means, said gear means being connected to said first boom section and to said cradle means and including at least one gear disposed in a coaxial relationship with said first opening and having surface means defining a second opening in said one gear which is coaxial with said first opening, said first motor means including a first end portion extending through said first opening in said end wall of said first boom section and through said second opening in said one gear, said first motor means being spaced apart from said end wall of said first boom section and from said surface means defining said second opening in said one gear, said force transmitting means further including means for connecting said end portion of said first motor means to said end portion of said cradle means to transmit thrust forces from said first motor means to said end portion of said cradle means independently of said first boom section.

2. An apparatus as set forth in claim 1 further including means for connecting a second end portion of said motor means with said second boom section.

3. An apparatus as set forth in claim 1 wherein said gear means includes a ring gear disposed in said cavity and fixedly connected with said cradle means, said ring gear having a plurality of internal teeth disposed in an annular array about a first central axis, said one gear being connected with said first boom section and having a second central axis which is offset relative to said first central axis, said one gear being circumscribed by said ring gear and having a plurality of external teeth at least some of which are disposed in engagement with said internal teeth on said ring gear, and eccentric means for effecting orbital movement of said one gear relative to said ring gear under the influence of drive forces transmitted from said second motor means, said internal teeth on said ring gear and said external teeth on said one gear cooperating during orbital movement of said one gear relative to said ring gear to rotate said one gear about said second central axis to effect rotation of said first boom section relative to said cradle means.

4. An apparatus as set forth in claim 3 wherein said gear means further includes a third gear disposed in said cavity and connected with said eccentric means and having a central axis which is coaxial with said first central axis, and means for rotating said third gear and said eccentric means about said first central axis under the influence of said second motor means.

5. An apparatus as set forth in claim 4 wherein said means for rotating said third gear includes a fourth gear connected with said second motor means and disposed in meshing engagement with said third gear, said second motor means being fixedly connected with said cradle means and operable to effect rotation of said fourth gear about its central axis.

6. An apparatus as set forth in claim 3 wherein said force transmitting means further includes first bearing means disposed in said cavity for supporting said one gear for rotational and orbital movement relative to said ring gear, said first bearing means having a central axis which is coaxial with said second central axis, and second bearing means for supporting said eccentric means for rotation about said first central axis.

7. An apparatus as set forth in claim 6 wherein said force transmitting means further includes third bearing means for supporting said first boom section for rotational movement about said first central axis and for preventing axial and radial movement of said first boom section along said first central axis during rotation of said first boom section.

8. A material handling apparatus comprising a base, a longitudinally extending first boom section having axially inner and outer end portions, said outer end portion of said first boom section including surface means for defining a first opening, a second boom section telescopically disposed within said first boom section and extending through said first opening, cradle means connected with said base for supporting said first and second boom sections, said cradle means including a longitudinally extending body which at least partially defines a cavity for receiving said first boom section and an end portion connected with said body to at least partially define one end of said cavity, said inner end portion of said first boom section being disposed adjacent to said end portion of said cradle means, first motor means for effecting axial movement between said first and second boom sections to vary the telescopic relationship between said boom sections, gear means disposed in said cavity between said inner end portion of said first boom section and said end portion of said cradle means and operable to effect rotation of said first and second boom sections relative to said cradle means, said gear means including a ring gear disposed in said cavity and fixedly connected to said cradle means and a second gear connected with the inner end portion of said first boom section and disposed in meshing engagement with and circumscribed by said ring gear, and second motor means for effecting rotation of said second gear relative to said ring gear to rotate said first and second boom sections.

9. An apparatus as set forth in claim 8 wherein said inner end portion of said first boom section includes surface means for defining a second opening, said first motor means being connected with said end portion of said cradle means and extending through said first boom section into engagement with said second boom section to transmit axial thrust forces between said second boom section and said cradle means independently of said first boom section.

10. An apparatus as set forth in claim 8 wherein said first motor means is spaced apart from and extends through said ring gear into engagement with said end portion of said cradle means.

11. An apparatus as set forth in claim 8 wherein said gear means includes eccentric means for effecting orbital movement of said second gear relative to said ring gear under the influence of drive forces transmitted from said second motor means, said internal teeth on said ring gear and said external teeth on said second gear cooperating during orbital movement of said second gear relative to said ring gear to rotate said second gear about its central axis.

12. An apparatus as set forth in claim 11 wherein said gear means further includes a third gear connected with said eccentric means and having a central axis which is coaxial with the central axis of said ring gear and means for rotating said third gear and said eccentric means about the central axis of said ring gear under the influence of said second motor means.

13. An apparatus as set forth in claim 12 wherein said means for rotating said third gear includes a fourth gear connected with said second motor means and disposed in meshing engagement with said third gear, said second motor means being fixedly connected with said cradle means and operable to effect rotation of said fourth gear about its central axis.

14. A material handling apparatus comprising a base, a plurality of longitudinally extending and telescopically disposed boom sections, cradle means connected with said base for supporting said boom sections, first motor means for effecting movement of at least one of said boom sections along its longitudinal axis to vary the telescopic relationship between said boom sections, gear means operable to effect rotation of at least a first one of said boom sections about its longitudinal axis, said gear means comprising a ring gear fixedly connected with said cradle means and having a plurality of internal teeth disposed in an annular array about a first central axis, said first central axis being disposed in a coaxial relationship with the longitudinal central axis of said first boom section, a second gear having a second central axis which is offset from and extends parallel to said first central axis, said second gear being circumscribed by said ring gear and having a plurality of external teeth at least some of which are disposed in engagement with said internal teeth on said ring gear, and eccentric means rotatable about said first central axis to effect orbital movement of said second gear relative to said ring gear, said internal teeth on said ring gear and said external teeth on said second gear cooperating during orbital movement of said second gear relative to said ring gear to rotate said second gear about said second central axis, second motor means connected with said cradle for effecting rotation of said eccentric means about said first central axis to thereby effect operation of said gear means, means for transmitting rotational movement from said second gear to said first one of said boom sections upon operation of said gear means to thereby effect rotation of said first one of said boom sections about its longitudinal axis and said second gear includes surface means for defining a central opening in said second gear, said first motor means including a piston and cylinder assembly which extends through said opening in said second gear and is spaced apart from said second gear.

15. A material handling apparatus as set forth in claim 14 wherein said gear means further includes a third gear connected with said eccentric means and having a central axis which is coaxial with said first central axis, said third gear being rotatable about said first central axis under the influence of said second motor means to effect rotation of said eccentric means about said first central axis.

16. An apparatus as set forth in claim 14 wherein said gear means includes first bearing means disposed between said eccentric means and said second gear for rotatably supporting said second gear on said eccentric means, said first bearing means being disposed in a coaxial relationship with said second central axis.

17. An apparatus as set forth in claim 16 wherein said gear means further includes second bearing means for supporting said eccentric means for rotation relative to said cradle means, said second bearing means being disposed in a coaxial relationship with said first central axis.

18. An apparatus as set forth in claim 17 further including third bearing means for at least partially supporting said first one of said boom sections for rotational movement relative to said base and for retaining said first one of said boom sections against axial movement relative to said base, said third bearing means being disposed in a coaxial relationship with said first central axis.

19. A material handling apparatus comprising a base, a cradle disposed on said base, said cradle including means for defining a cradle cavity, a longitudinally extending boom section disposed within said cradle, said longitudinally extending boom section having an end portion disposed in said cradle cavity, first bearing means for at least partially supporting said boom section for rotation relative to said cradle about its longitudinal axis, a drive motor connected with said cradle, and means connected with said drive motor and said boom section for effecting rotation of said boom section about its longitudinal axis relative to said cradle upon operation of said drive motor, said means for effecting rotation of said boom section including a ring gear disposed within said cradle cavity adjacent to said end portion of said boom section and fixedly connected with said cradle, said ring gear having a plurality of internal teeth disposed in an annular array and in a coaxial relationship with the longitudinal axis of said boom section, a second gear connected with said end portion of said boom section, said second gear being circumscribed by said ring gear and having a plurality of external teeth at least some of which are disposed in meshing engagement with said internal teeth on said ring gear, means for supporting said second gear for rotation about a second axis which is spaced apart from and extends parallel to the longitudinal axis of said boom section, means for effecting orbital movement of said second gear relative to said ring gear about the longitudinal axis of said boom section at a first rate upon operation of said drive motor, said means for effecting orbital movement of said second gear including a ring member having a circular outer surface disposed in a coaxial relationship with said second axis, said drive motor being operable to rotate said ring member about the longitudinal axis of said boom section to impart eccentric rotational motion to said circular outer surface of said ring member, said second gear being orbital relative to said ring gear under the influence of the eccentric rotational motion of the circular outer surface of said ring member, said second gear being rotatable about said second axis at a second rate under the influence of the internal teeth on said ring gear and the external teeth on said second gear upon orbital movement of said second gear relative to said ring gear, said second rate of rotation of said second gear about said second axis being less than said first rate of orbital movement of said second gear about the longitudinal axis of said boom section, and means for transmitting rotary motion from said second gear to said boom section upon rotation of said second gear about said second axis to rotate said boom section about its longitudinal axis at a rate which is directly proportional to the rate of rotation of said second gear about said second axis.

20. An apparatus as set forth in claim 19 wherein said second gear includes surface means defining a circular opening circumscribing said circular outer surface of said ring member, said means for effecting rotation of said boom section further including bearing means disposed between said circular outer surface of said ring member and said surface means of said second gear.

21. A material handling apparatus comprising a base, a longitudinally extending first boom section having axially inner and outer end portions, said inner end portion of said first boom section having an end wall which defines a first opening, a longitudinally extending second boom section telescopically disposed within said first boom section and extending through said axially outer end portion of said first boom section, cradle means connected with said base for supporting said first and second boom sections, first motor means for effecting axial movement between said first and second boom sections to vary the telescopic relationship between said boom sections, second motor means for effecting rotational movement of said first and second boom sections about their longitudinally extending axes, and force transmitting means for transmitting rotational drive forces from second motor means to said first boom section and for retaining said first boom section against axial movement relative to said cradle means, said cradle means including a longitudinally extending body which at least partially defines a cavity for receiving said first boom section and an end portion connected with said body and extending transversely to the longitudinal axis of said body to at least partially define one end of said cavity, said inner end portion of said first boom section including an end wall disposed adjacent to said end portion of said cradle means, said force transmitting means including gear means disposed within said cavity between said end wall of said first boom section and said end portion of said cradle means, said gear means including a ring gear fixedly connected with said cradle means, said ring gear having a plurality of internal teeth disposed in an annular array and in a coaxial relationship with the longitudinal axis of said first boom section, a second gear circumscribed by said ring gear and having a plurality of external teeth at least some of which are disposed in meshing engagement with said internal teeth on said ring gear, means for supporting said second gear for rotation about a second axis which is spaced apart from and extends parallel to the longitudinal axis of said boom section, means for effecting orbital movement of said second gear relative to said ring gear about the longitudinal axis of said boom section at a first rate upon operation of said second motor means, said means for effecting orbital movement of said second gear including a ring member having a circular outer surface disposed in a coaxial relationship with said second axis, a third gear connected with said ring member in a coaxial relationship the longitudinal axis of said first boom section, and drive means for rotating said third gear and said ring member about the longitudinal axis of said first boom section under the influence of said second motor means, said second gear being rotatable about said second axis at a second rate under the influence of the internal teeth on said ring gear and the external teeth on said second gear upon orbital movement of said second gear relative to said ring gear, said second rate of rotation of said second gear about said second axis being less than said first rate of orbital movement of said second gear about the longitudinal axis of said boom section, said force transmitting means further including means for transmitting motion from said second gear to said boom section upon rotation of said second gear about its longitudinal axis at a rate which is directly proportional to the rate of rotation of said second gear about said second axis, surface means for defining a passage extending through said end wall of said first boom section, said second gear, said ring member and said third gear, said first motor means being spaced apart from said surface means and extending through said passage means, and means for connecting said first motor means to said end portion of said cradle to transmit force from said first motor means to said end portion of said cradle means.

* * * * *